US011013289B1

(12) United States Patent
Lucero

(10) Patent No.: US 11,013,289 B1
(45) Date of Patent: May 25, 2021

(54) HARD HAT WITH AN INTEGRAL COMMUNICATION SYSTEM

(71) Applicant: Raymond Lucero, Hermosa, CA (US)

(72) Inventor: Raymond Lucero, Hermosa, CA (US)

( * ) Notice: Subject to any disclaimer, the term of this patent is extended or adjusted under 35 U.S.C. 154(b) by 0 days.

(21) Appl. No.: 16/663,520

(22) Filed: Oct. 25, 2019

(51) Int. Cl.

| | |
|---|---|
| ***H04M 1/00*** | (2006.01) |
| ***A42B 3/30*** | (2006.01) |
| ***A42B 3/32*** | (2006.01) |
| ***A42B 3/12*** | (2006.01) |
| ***A42B 3/06*** | (2006.01) |

(52) U.S. Cl.
CPC ..... *A42B 3/30* (2013.01); *A42B 3/06* (2013.01); *A42B 3/12* (2013.01); *A42B 3/324* (2013.01)

(58) Field of Classification Search
CPC .... A42B 3/30; A42B 3/06; A42B 3/12; A42B 3/324
USPC ..... 455/575.2
See application file for complete search history.

(56) References Cited

U.S. PATENT DOCUMENTS 133,239 A 11/1872 McGrew
4,833,726 A * 5/1989 Shinoda ..... A42B 3/30 381/376
5,404,577 A * 4/1995 Zuckerman ..... A42B 3/30 455/351
5,678,205 A * 10/1997 Gray ..... A42B 3/10 455/348
6,208,260 B1 * 3/2001 West ..... B66C 15/06 340/5.1
6,232,887 B1 * 5/2001 Carson ..... B61L 23/06 340/4.21
6,298,249 B1 * 10/2001 Locarno ..... A42B 3/14 2/417
6,609,913 B1 * 8/2003 Batts ..... A42B 1/004 2/5
6,798,392 B2 * 9/2004 Hartwell ..... A42B 3/30 345/158
7,110,743 B2 * 9/2006 Depew ..... A42B 3/14 381/375
7,298,258 B1 * 11/2007 Hudgens ..... G08B 21/22 340/539.13
8,233,947 B2 * 7/2012 Kushnirov ..... A42B 3/30 455/575.2
8,618,936 B2 * 12/2013 Niederer, III ..... A42B 3/227 340/540

(Continued)

*Primary Examiner* — April G Gonzales
(74) *Attorney, Agent, or Firm* — Sanchelima & Associates, P.A.; Christian Sanchelima; Alexander Rodriguez

(57) ABSTRACT

A hard hat with an integral communication system including a hat assembly and a communication assembly is disclosed. The hard hat has a visor and is secured around the head of a user with a head harness. The hard hat includes speakers and a microphone. Importantly, there is a control box having a microprocessor, a wireless communication module and a channel selector. There are buttons used to power on the communications system and to activate the microphone. Once a user is ready to communicate with another user wearing a similar hard hat and on a same communication channel, one of the buttons is pressed and the user can speak, which will result in the microphone picking up the sound and sending it to another user's speakers. Thereby allowing wearers of the hard hat to be able to communicate wirelessly effortlessly.

17 Claims, 3 Drawing Sheets

(56) References Cited

U.S. PATENT DOCUMENTS

| | | | | |
|---|---|---|---|---|
| 9,013,297 | B1 * | 4/2015 | Dey | G08B 21/02 340/539.11 |
| 9,486,027 | B2 * | 11/2016 | Dey | A42B 3/04 |
| 9,642,574 | B2 * | 5/2017 | Zhavoronkov | A42B 3/046 |
| 10,217,345 | B1 * | 2/2019 | Nanjappan | H04W 4/027 |
| 10,383,384 | B2 * | 8/2019 | Zhavoronkov | A42B 3/042 |
| 10,667,571 | B2 * | 6/2020 | Sengupta | G08B 21/22 |
| 2004/0261158 | A1 * | 12/2004 | Depew | A42B 3/30 2/422 |
| 2006/0057972 | A1 * | 3/2006 | Wikel | A42B 3/30 455/90.3 |
| 2012/0304367 | A1 * | 12/2012 | Howard | A42B 3/046 2/413 |
| 2012/0304767 | A1 * | 12/2012 | Howard | A61B 5/0004 73/504.03 |
| 2014/0208487 | A1 * | 7/2014 | Orientale | A42B 3/0433 2/422 |

* cited by examiner

HARD HAT WITH AN INTEGRAL COMMUNICATION SYSTEM

BACKGROUND OF THE INVENTION

1. Field of the Invention

The present invention relates to a hard hat and, more particularly, to a hard hat with an integral communication system that allows communication to occur between users wearing the hard hat at distant locations.

2. Description of the Related Art

Several designs for hard hats have been designed in the past. None of them, however, include a hard hat having an integral communication system comprising a wireless communications module mounted at the back of the helmet, as well as speakers mounted opposite to the ears of the wearer, the hard hat also has a microphone and controls mounted on the underside of the visor of the hard hat. There is often a need on job sites such as construction job sites for coworkers to communicate even when not in the direct presence of one another. Currently, communication can occur over radio, walkie talkies, or mobile devices such as cell phones. However, those means are not practical nor efficient at times because with the cumbersome equipment being worn those current communication means become difficult to operate. With gloves intended for protection during construction work, the buttons on a cellphone or walkie talkie become difficult to operate. Further, to use those communication means additional equipment must be carried. Hence, there is a need for a hard hat having wireless communication means that is easy to operate even while wearing cumbersome equipment such as gloves intended for construction work. With the present invention, there is further no need to carry additional equipment as hard hats are mandatory to be worn for certain jobs and job sites. The present invention is built into equipment that is already carried or worn and is easier to operate that current communication means available.

Applicant believes that a related reference corresponds to U.S. patent No. 2019/0133239 issued to Hassan Fahad Albalawi for Integrated Wireless Head Protection Garment and Harness. It is an integrated wireless head protection garment and harness with an integrated wireless communication device including a head garment for wearing. The wireless communication device is attached to the harness. The wireless communication device includes a casing that houses a micro processing unit and a wireless module along with a depressible button. The button initiates communication of sensor data including at least an event signal to another device by means of the micro processing unit and wireless module over a wireless communication unit thereby facilitating 2 way communication with wearers of the device. However, it differs from the present invention because the Albalawi reference is less capable than the present invention. The depressible button of the Albalawi reference is at location that is less optimal than the location of the button on the present invention. Further, the current invention can be easily operated even with cumbersome equipment being worn. Additionally, the present invention can be retrofitted onto already existing hard hats as known in the art. The present invention also has a variety of way in which it can be used and operated.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a hard hat with wireless communication means integrated thereon.

It is another object of this invention to provide a hard hat with wireless communication that allows for communication to occur between users at distant locations.

It is still another object of the present invention to provide a hard hat with wireless communication that includes various modes to be operated as best may be suited for an individual or user.

It is another object of the present invention to provide a hard hat with wireless communication that can be easily operated even while a user is wearing cumbersome equipment.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
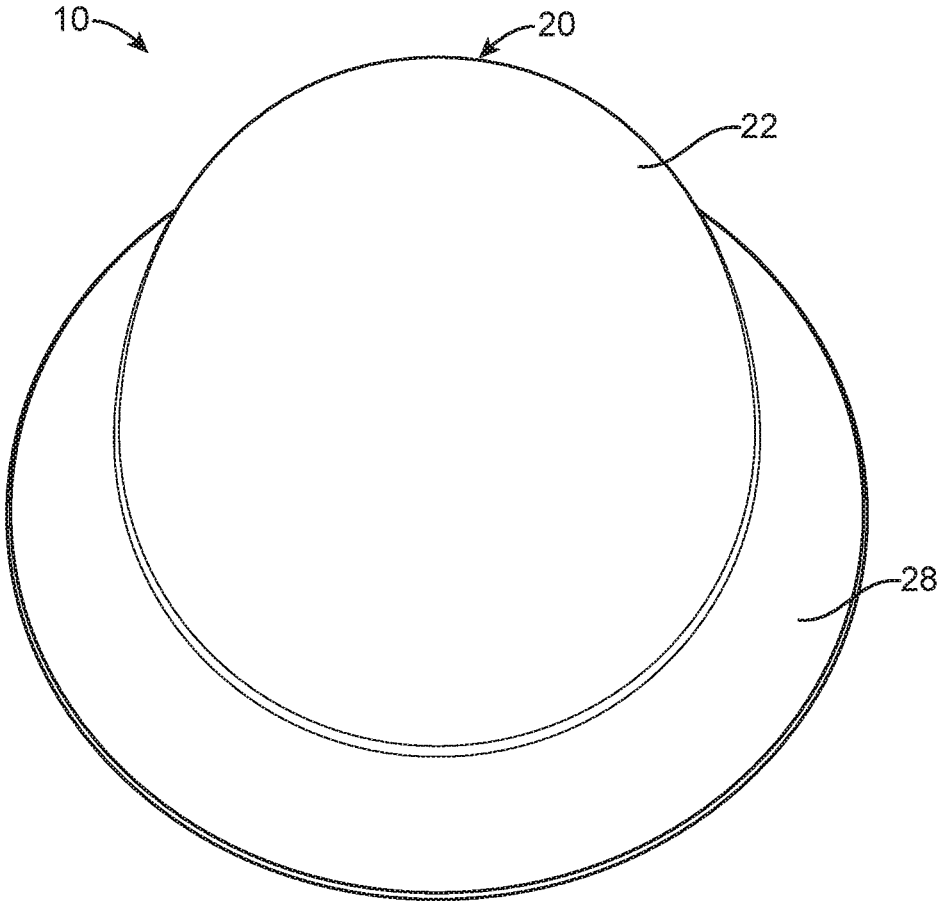
FIG. 1 represents an isometric view of the present invention.

Referring now to the drawings, where the present invention is generally referred to with numeral 10, it can be observed that it, a hard hat 10, basically includes a hat assembly 20 and an integral communication system being a communication assembly 60.

There is always a need to communicate with coworkers no matter what field of work a person may find themselves in. It is essential for coworkers in the field of construction to communicate with one another as they are coining together to construct buildings. Currently, there are means that permit communicating amongst workers in the construction field, such as by mobile devices, radios, or walkie talkies. However, with the cumbersome protective gear often worn it becomes difficult to operate those aforementioned means of communication. Further, it would require for additional equipment to be carried. However, as per safety requirements it is mandatory that hard hats be worn by workers. Hence, there is a need for the present invention, which is a hard hat that has an integral communication system.

Figure 2:
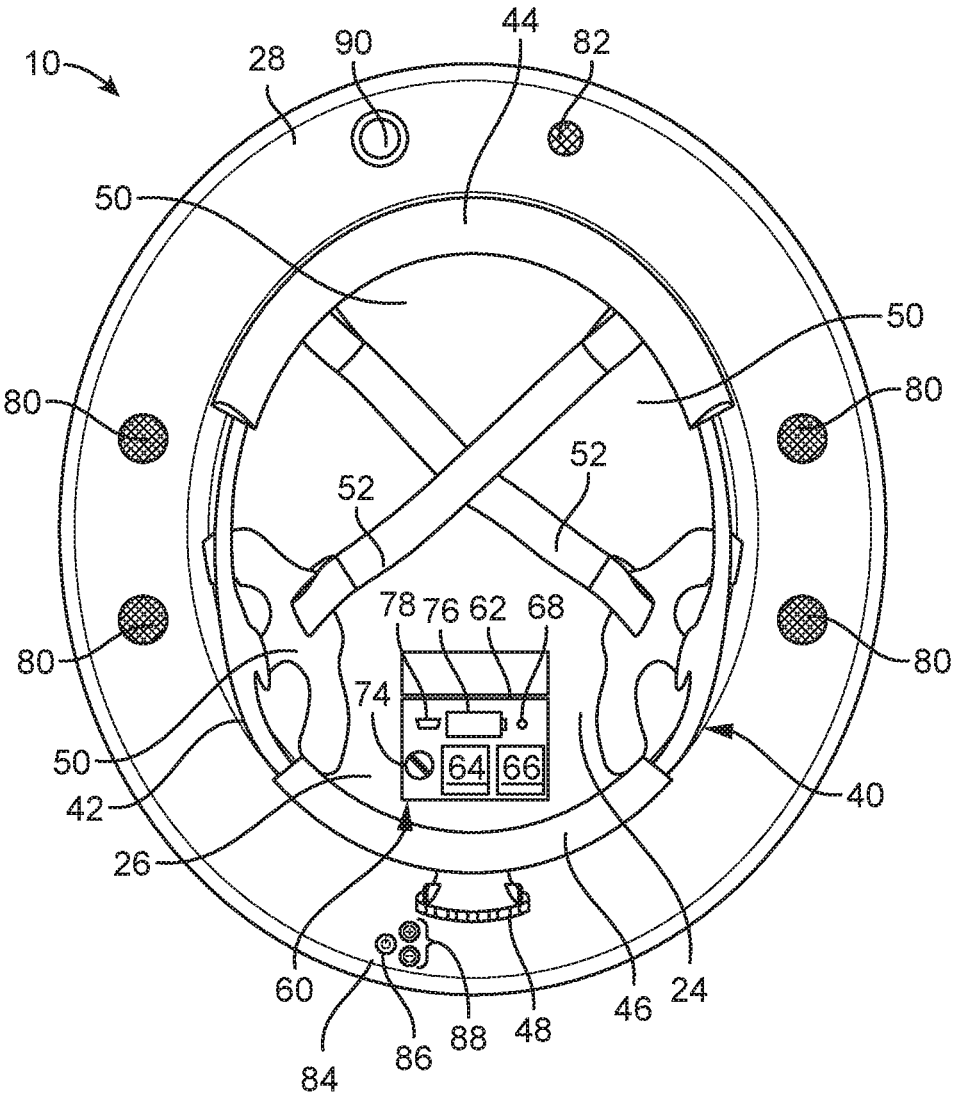
FIG. 2 shows a bottom of the present invention.
Figure 3:
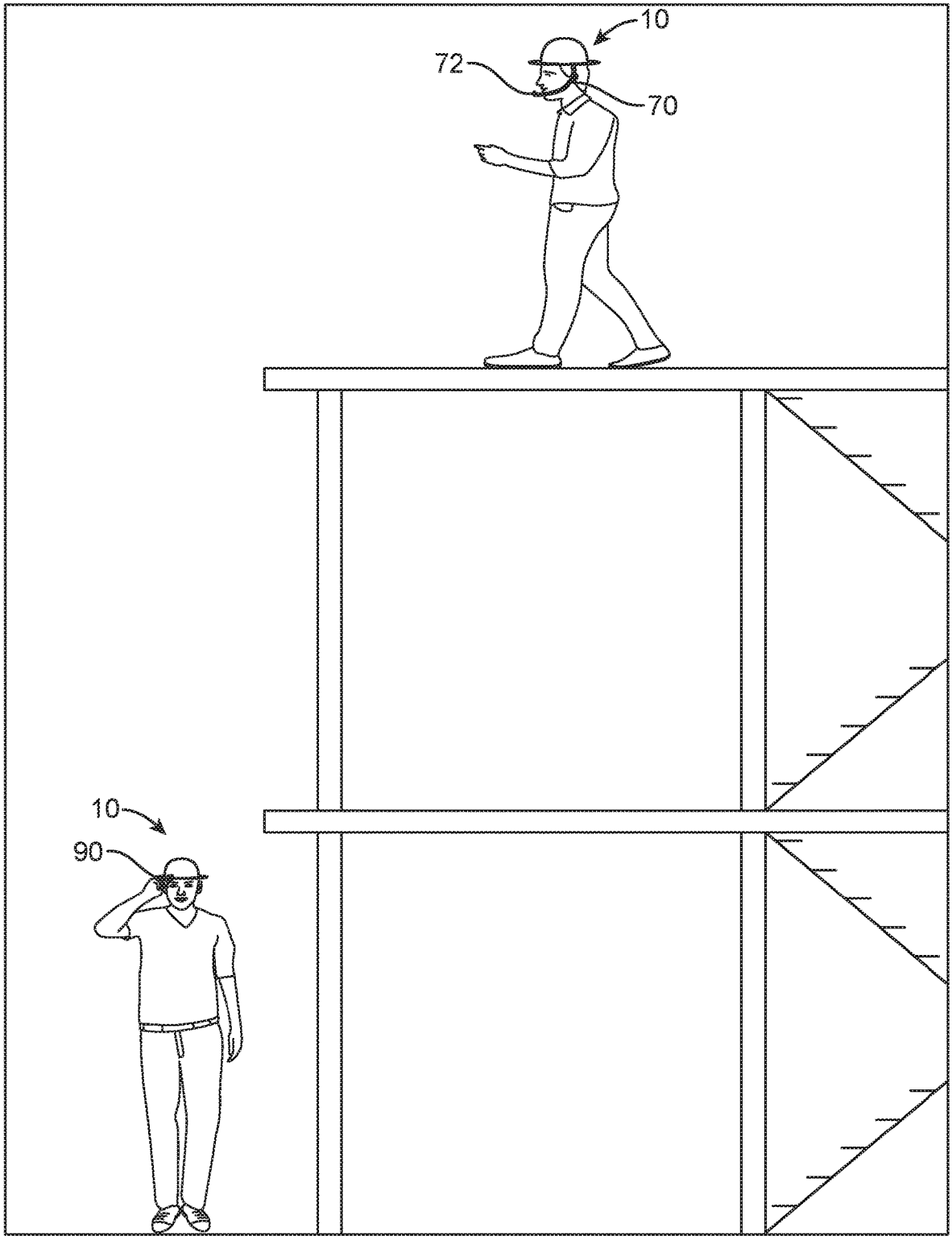
FIG. 3 illustrates the present invention in an operation setting in which multiple users are communicating with the use of the present invention.

Referring to FIGS. 1-3, it can be seen that hard hat 10 includes means that allow for a user to wear hard hat 10. Hard hat 10 includes hat assembly 20 which includes outer surface 22 and an inner surface 24. Outer surface 22 may preferably be of a rigid and strong material that can resist and absorb forceful impact. Inner surface 24 may include a head opening 26 adapted to receive a head of the user. Hard hat 10 may also include a perimeter about head opening 26. About the perimeter of hard hat 10 may be a visor 28 mounted thereon. Visor 28 may be adapted to provide shade to the user wearing hard hat 10 as protection from the sun and heat. Visor 28 may extend outwardly from the perimeter of head opening 26.

Hard hat 10 may further include mounting assembly 40. Mounting assembly 40 facilitates wearing of hard hat 10 by a user. Mounting assembly 40 may be located on inner surface 24 of hard hat 10. Mounting assembly 40 may be, more specifically, mounted about head opening 26. Mounting assembly 40 may include a head harness 42 adapted to secure hard hat 10 around the head of the user. Head harness 42 may preferably be circular or oval shaped to cooperate with the shape of the head of the user. Head harness 42 extends about the perimeter of the head of a person. At a front portion of head harness 42 may be a front cushion 44. Front cushion 44 may be adapted to provide comfort and protection to the forehead of the user and the front of the head of the user. Front cushion 44 may partially extend about a front portion of head harness 44. Mounting assembly 40 may further include a rear cushion 46 at a rear portion of head harness 44. Rear cushion 46 may be adapted to provide comfort and added protection to the back of the head of the user. Rear cushion 46 may partially extend about a rear portion of head harness 42. Mounting assembly 40 may further include a harness knob 48 mounted to head harness 42 adjacent to rear cushion 46. Harness knob 48 may preferably be circular shaped, but any other shape may be suitable. Harness knob 48 may include perimeter having grip portions mounted thereon. Harness knob 48 may be used to tighten or loosen head harness 42 in order to comfortably and securely be mounted to the head of the user. This allows for head harness 42 to cooperate with different sized heads. Head harness 42 may be mounted to hard hat 10 at inner surface 24 with the use of mounting brackets 50. Any number of mounting brackets 50 may be suitable to secure head harness 42 to hard hat 10. In the immediate embodiment, four of mounting brackets 50 are used to secure head harness 42 to hard hat 10. Extending diagonally therebetween mounting brackets 50 may be elastic bands 52 of a predetermined dimension, shape and material. In the immediate embodiment of the present invention two of elastic bands 52 are used. Elastic bands 52 go against the top of the head of the user. Elastic bands 52 are adapted to prevent hard hat 10 from making direct contact with the head of the user. Elastic bands 52 absorb the shock of impact that may occur on hard hat 10. Thereby minimizing pain and damage that a person might undergo should hard hat 10 be forcibly impacted from above.

It can be seen that hard hat 10 includes an integral communication system. The integral communication system being a communication assembly 60. Communication assembly 60 permits wireless communication to be possible amongst wearers of hard hat 10. Importantly, communication assembly 60 includes a control box 62 adapted to enclose or house other components of the present invention, such as electrical components, therein. Control box 62 may be virtually of any shape, however, it may be preferable for control box 62 to be square or rectangular shaped. It may be suitable for control box 62 to be light weight. Preferably, control box 62 may be made of carbon fiber, but other materials such as plastic, rubber, aluminum or metal may be suitable as well. Control box 62 may be mounted at inner surface 24 of hard hat 10. Preferably, control box 62 may be mounted near the same side as rear cushion 46.

Housed within control box 62 is a microprocessor 64 adapted to permit function and communication of all components of the present invention with one another. Microprocessor 64 may include a wireless communication module 66 adapted to allow for wireless communication with and from the present invention in the form of Bluetooth, Wi-Fi, RF, RFID, radio waves, LTE, 4G, 5G or any other forms of wireless communication as known in the art. Control box 62 may also include a headphone jack 68 adapted to receive headphones 70 therein. Headphones 70 may have a headphone microphone 72 thereon. Headphone jack 68 may be any predetermined dimension to be capable of receiving any predetermined male member of headphones 70. Further, in an alternate embodiment, it may be suitable for headphones 70 to be wireless headphones to be connected to microprocessor 64 with the use of wireless communication module 66. Thereby allowing for use of headphones 70 which are wireless to be used with the present invention for hearing or speaking with the present invention. Further enclosed or housed within control box 62 may be a channel selector 74. Channel selector 74 may be adapted to allow choosing of a channel for which all using the same channel may communicate with one another. Channel selector 74 has a predetermined number of channels to choose from. All users using hard hat 10 wanting to communicate with one another must be all on the same channel chosen on channel selector 74. Channel selector 74 allows for coworkers or users to be grouped into smaller groups that require communication with one another in order to complete the current task. Additionally, housed within control box 62 may be a battery 76. Battery 76 may be adapted to provide power to all components, particularly all electrical components. Battery 76 may preferably be rechargeable. Battery 76 may be recharged through a charging port 78 located mounted therein control box 62. More specifically, charging port 78 may be mounted on microprocessor 64 to provide charge and power to battery 76 after it has been drained or depleted of power. Charging port 78 may be a USB port or any port for connection of a cable for electricity to run through to battery 76.

Communication assembly 60 may contain additional components such as speakers 80, a microphone 82 and controls 84. Controls 84 may be one of a power button 86, volume buttons 88 or an activation button 90. Preferably, speakers 80, microphone 82 and controls 84 may be mounted to an underside of visor 28. Speakers 80 may preferably be mounted on the peripheral sides of visor 28 near the ears of users. There may be a plurality of speakers 80 mounted thereon the present invention. In the immediate embodiment there may be two of speakers 80 on each of a left and right side of visor 28 that corresponds with a left and right ear of the user. It may be suitable for at least one of speakers 80 to be mounted on the present invention. Speakers 80 may be adapted to emit sounds from other users communicating through the use of hard hat 10. Microphone 82 may be, preferably, at a front end of visor 28 nearest to front cushion 44. Activation button 90 and volume buttons 88 may preferably be at a front end of the underside of visor 28 as well.

In order to operate the present invention, the user may do as follows. Firstly, hard hat 10 may be turned off and on with power button 86. The user may then mount hard hat 10 around their head. With hard hat 10 being on and secured around the head of a user with mounting assembly 40 the present invention can be operated. The user can select a desired channel on which communication can take place with channel selector 74. Preferably, everyone that must communicate with one another may be on one same channel A first user can then press activation button 90 and speak freely, the voice of the user will be picked up by microphone 82. The voice, message or sounds picked up by microphone 82 will be emitted to other users or a second user wearing hard hat 10 and being on the same channel as the first user through speakers 80. The users may all adjust the volume of speakers 80 with volume buttons 88. The second user or other users may respond back or communicate back in the same manner. Activation button 90 is pressed and the users can speak into microphone 82 to be heard by others on a same channel through speakers 80. It may be necessary to hold activation button 90 to be heard through speakers 80. Microphone 82 may only pick up sounds if activation button 90 is pressed. Activation button 90 may be pressed even while cumbersome equipment such as work gloves are being worn.

In the event that headphones 70, wireless or otherwise, are connected to hard hat 10 the present invention changes into a different mode. The present invention includes a manual and an automatic mode. With headphones 70 connected to the present invention there is no need for activation button 90 to be operated and as such the automatic mode is activated. Instead, a user may speak freely into headphone microphone 72 to be heard either at speakers 80 or headphones 70 of a different hard hat 10 being worn by another user, depending on the mode that other user or users may be in. With headphones 70 connected to the present invention communication of other users does not occur through speakers 80, but instead through headphones 70. Without headphones 70 being connected to the present invention the manual mode is activated and there is a need to operate activation button 90 for communicating with the present invention.

It should be understood that the present invention should not be limited by dimensions, shape, materials or colors. It may be suitable for dimensions and materials to be used depending on what may be best suitable for a user. It should be understood that the present invention allows for communication either in real time or delayed a predetermined amount. A user can speak to others using the present invention even while being apart a predetermined distance. This allows for work and communication to be completed at different locations of a job site, for example.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a hard hat, comprising:

a) a hat assembly including a hat having an inner surface, said hat including a visor extending about a perimeter thereof, said hat having a head opening, a mounting assembly having a head harness mounted entirely within said hat, said head hardness extending entirely along said head opening, said head hardness secured within said hat with mounting brackets, said mounting brackets fixedly mounted about said head opening on said inner surface, wherein said mounting brackets extending into an inner portion of the hat, said mounting brackets being fixedly mounted to an inner perimeter of said head opening, said mounting brackets including elastic bands extending therebetween, said head harness including a front cushion and a back cushion, said front cushion and said back cushion extending a partial length of said head harness, said head harness including a harness knob to adjust the tightness of said head harness to secure said head harness and said hat properly to the head of the user, said harness knob being adjacent to said back cushion, said harness knob being entirely below said visor, wherein said harness knob is a C-shaped member;

b) an integral communication system being a communication assembly integrated into said hat;

c) a control box housing said communication assembly, said control box secured to said inner surface of the hat, wherein said control box is rectangular in shape and is located entirely between said mounting brackets, wherein said control box includes a microprocessor and a wireless communication module adapted for wireless communication, wherein said control box further includes a headphone jack which receives headphones, wherein said control box further includes a channel selector being a circular member, wherein said control box further includes a battery that is charged via a charging port located on the control box;

d) said control box being secured between said front cushion and said back cushion;

e) speakers secured to an underside of said visor, wherein said speakers are circular speaker elements which are exposed along said underside, said speakers being spaced apart;

f) a microphone secured to said visor along the underside thereof, said microphone being at a front of said visor adjacent to said front cushion;

g) controls secured to the underside of said visor, said controls being a power button, volume buttons, and an activation button, said power button and said volume buttons being adjacent to said back cushion, said activation button being adjacent to said front cushion, said activation button actuated to selectively activate said microphone to allow the user to speak into microphone, said processor permitting communication between said activation button and said microphone.

2. The system of claim 1, wherein said hat includes an automatic and manual mode.

3. The system of claim 2, wherein in said automatic mode, said headphones are connected to said headphone jack and a first user can speak freely into said headphone microphone to be heard through said speakers of additional users wearing said hat, said first user hears communication from said users through said headphones.

4. The system of claim 2, wherein in said manual mode the user must actuate said activation button to communicate via said microphone to be heard by other users wearing said hat.

5. The system of claim 1, wherein said hat has said speakers mounted adjacent to the ears of the user and said head harness, said speakers being parallel to each other.

6. The system of claim 1, wherein a wireless communication module is secured to said microprocessor, said wireless communication module allows communication via Bluetooth, Wi-Fi, RF, RFID, radio waves, LTE, 4G or 5G between users of said hat.

7. The system of claim 1, wherein said visor provides protection from the sun and heat in the form of shade.

8. The system of claim 1, wherein said elastic bands intercross one another.

9. The system of claim 1, wherein said elastic bands are secured to said mounting brackets being diagonally opposite one another.

10. The system of claim 1, wherein said control box is secured between said front cushion and said back cushion.

11. The system of claim 1, wherein said control box is secured between said mounting brackets.

12. The system of claim 1, wherein said hat includes an outer surface, said outer surface being rigid.

13. The system of claim 1, wherein said visor includes a same constant width along a visor perimeter.

14. The system of claim 1, wherein said control box is made of carbon fiber.

15. The system of claim 1, wherein said front cushion has a length greater than that of said back cushion.

16. The system of claim 1, wherein said harness knob is perpendicular to said head harness and is rotatable.

17. A system for a hard hat, consisting of:

a. a hat assembly including a hat having an inner surface, said hat including a visor extending about a perimeter thereof, said visor extending outwardly and away from said hat, said visor having a constant width, said hat having a head opening extending in between said visor, said head opening and said visor being in abutting contact, a mounting assembly having a head harness mounted entirely within said hat, said head hardness extending entirely along said head opening, said head hardness secured within said hat with mounting brackets, said mounting brackets fixedly mounted about said head opening on said inner surface, wherein said mounting brackets extending into an inner portion of the hat, said mounting brackets being fixedly mounted to an inner perimeter of said head opening, said mounting brackets including elastic bands extending therebetween, said elastic bands secured to diagonally opposite of said mounting brackets, said elastic bands intercrossing and overlapping each other, said head harness including a front cushion and a back cushion, said front cushion and said back cushion extending a partial length of said head harness, said front cushion having a length greater than said back cushion, said head harness including a harness knob to adjust the tightness of said head harness to secure said head harness and said hat properly to the head of the user, said harness knob being adjacent to said back cushion, said harness knob being entirely below said visor, said harness knob being perpendicular to said head harness;

b. an integral communication system being a communication assembly integrated into said hat;

c. a control box housing said communication assembly, said control box secured to said inner surface of said hat, wherein said control box is rectangular in shape and is located entirely between said mounting brackets, wherein said control box includes a microprocessor and a wireless communication module adapted for wireless communication, wherein said control box further includes a headphone jack which receives headphones, wherein said control box further includes a channel selector being a circular member, wherein said control box further includes a battery that is charged via a charging port located on the control box;

d. said control box being secure between said front cushion and said back cushion;

e. speakers secured to an underside of said visor, wherein said speakers are circular speaker elements which are exposed along said underside, said speakers being spaced apart;

f. a microphone secured to said visor along the underside thereof, said microphone being at a front of said visor adjacent to said front cushion;

g. controls secured to the underside of said visor, said controls being a power button, volume buttons, and an activation button, said power button and said volume buttons being adjacent to said back cushion, said activation button being adjacent to said front cushion, said activation button actuated to activate said microphone to allow the user to speak into microphone, said processor permitting communication between said activation button and said microphone.

* * * * *